US006543401B2

(12) United States Patent
Trease

(10) Patent No.: US 6,543,401 B2
(45) Date of Patent: Apr. 8, 2003

(54) CAMSHAFT DRIVE MECHANISM

(75) Inventor: John M. Trease, Pascoe Vale (AU)

(73) Assignee: American Spares & Repairs Pty., Ltd., Palm Beach (AU)

( * ) Notice: Subject to any disclaimer, the term of this patent is extended or adjusted under 35 U.S.C. 154(b) by 0 days.

(21) Appl. No.: 09/943,948

(22) Filed: Aug. 31, 2001

(65) Prior Publication Data

US 2003/0041824 A1 Mar. 6, 2003

(51) Int. Cl.[7] ..... F01L 1/02
(52) U.S. Cl. ..... 123/90.31; 123/90.17; 123/90.18
(58) Field of Search ..... 123/90.31

(56) References Cited

U.S. PATENT DOCUMENTS 5,385,125 A * 1/1995 Oyaizu et al. ..... 123/54.4
5,673,659 A * 10/1997 Regueiro ..... 123/501
5,752,479 A * 5/1998 Kinoshita et al. ..... 123/90.27
5,765,518 A * 6/1998 Nakano ..... 123/90.17
6,318,321 B1 * 11/2001 Kensok et al. ..... 123/90.17

OTHER PUBLICATIONS

"*World's Most Powerful Production Twin Cam Engine*", Pugsley, Live to Ride, May 2001, pp. 40–42.

* cited by examiner

*Primary Examiner*—Thomas Denion
*Assistant Examiner*—Jaime Corrigan
(74) *Attorney, Agent, or Firm*—DeLio & Peterson LLC; Peter W. Peterson

(57) ABSTRACT

A camshaft drive mechanism for a vee-twin engine is described. The mechanism comprises first and second camshafts which are driven by a gear on the crankshaft of an engine incorporating the mechanism. The crankshaft drive gear engages a primary (idler) gear on the first camshaft while a secondary gear on that camshaft imparts counter rotation on the second camshaft via an identical secondary gear on the latter camshaft.

10 Claims, 3 Drawing Sheets

CAMSHAFT DRIVE MECHANISM

TECHNICAL FIELD

This invention relates to internal combustion engines of the type comprising twin cylinders arranged in a vee in a plane normal to the crankshaft. More particularly, the invention relates to the camshaft included in such engines, which camshaft actuates the valves that control the flow of air/fuel mixture into and exhaust gas out of the cylinders.

BACKGROUND ART

A common type of motorcycle engine is the so-called "vee-twin" engine in which the two cylinders are arranged in a vee with the cylinders lying on a plane which is transverse to the crankshaft and normal thereto. The axes of the cylinders meet at the axis of the crankshaft.

Such engines also include a camshaft which is typically in the crankcase where it is driven by a pinion gear of the crankshaft. The camshaft, via pushrods and rocker arms, actuates valves which control the influx of air/fuel mixture from the carburetor and the efflux of combusted mixture.

Vee-twin engines are also known that have twin camshafts. Such engines usually have superior performance over an otherwise identical engine because of the improved pushrod geometry which gives better operation of the valves. The twin camshafts are driven by a chain running from a gear on the crankshaft.

The chain drive of the twin camshafts of engines of the foregoing type is unsatisfactory because of a limited service life due to the chain requiring adjustment or even replacement. Furthermore, chain breakage can occur with damage to the engine and in some instances injury to the rider of a motorcycle powered by the engine.

It would therefore be desirable to have available an internal combustion engine of the vee-twin configuration with dual camshafts wherein the camshaft drive mechanism is not a chain drive.

SUMMARY OF THE INVENTION

The object of the invention is to provide a camshaft drive mechanism for an internal combustion engine of the vee-twin configuration which does not use chain drive.

In a broad format, the invention provides a camshaft drive mechanism for an internal combustion engine of the type comprising twin cylinders arranged in a vee in a plane normal to the axis of the crankshaft of said engine, wherein said mechanism comprises a first camshaft for actuating inlet and exhaust valves of one of said cylinders and a second camshaft for actuating inlet and exhaust valves of the other of said cylinders, which camshafts rotate on axes parallel to the axis of said crankshaft, and wherein said camshafts are driven by a gear on said crankshaft which engages a primary gear on said first camshaft with an adjacent secondary gear on said first camshaft imparting counter-rotation on said second camshaft via an identical secondary gear on said second camshaft.

The inventors have found that by replacing the chain-drive of twin camshaft vee-twin engines with a gear-drive, the disadvantages referred to above of a chain drive are overcome. Furthermore, the inventors have surprisingly found that the long-term performance of an engine including the camshaft drive mechanism of the invention does not deteriorate, as does the performance of an engine with chain-driven camshafts.

A particular problem faced by the inventors in configuring a gear-drive mechanism for twin camshafts was to minimize the space occupied by the gears yet maintain lateral alignment of gears. This was achieved by use of thrust interfaces as will be explained in greater detail below.

The camshaft drive mechanism of the invention can be used for vee-twin engines having a vee of any angle. The mechanism is particularly suited for vee-twin motorcycle engines having a vee of 45° to 60°. The camshaft axis is advantageously in alignment with the axis of the cylinder with which it is associated. However, the camshaft axis can be offset by as much as 10° from the cylinder axis.

The crankshaft drive gear and primary camshaft gear—which in effect is an idler gear—are configured such that a camshaft turns at half the speed of the crankshaft. The diameters of the secondary gears are determined by the distance apart of the camshafts although it will be appreciated by one of ordinary skill in the art that the diameter of a secondary gear must be greater than the radius of the primary gear so that the secondary camshaft clears the primary gear.

The camshafts per se can be of any type or configuration suitable for use in vee-twin engines. Camshafts can have multiple lobes for actuating—via pushrods and rocker arms—more than one inlet and/or exhaust valve per cylinder.

A further embodiment of the invention is a crankcase incorporating the camshaft drive mechanism of the invention. This crankcase includes, as part of the casting, tappet blocks which house the cam followers. Conventional engines employ separate tappet blocks which are fixed to the crankcase. An integral tappet block contributes to the strength of the crankcase in the area of the cam chest.

One of ordinary skill in the art will appreciate that the more rigid drive train of the camshaft drive mechanism of the invention reduces vibration.

The invention also includes within its scope an engine comprising the camshaft drive mechanism described above.

BRIEF DESCRIPTION OF THE DRAWINGS

The invention will now be further described with reference to the accompanying drawings in which.

DETAILED DESCRIPTION OF SPECIFIC EMBODIMENTS

In the following detailed description, the same item number will be used for a feature visible in more than one figure.

Figure 1:
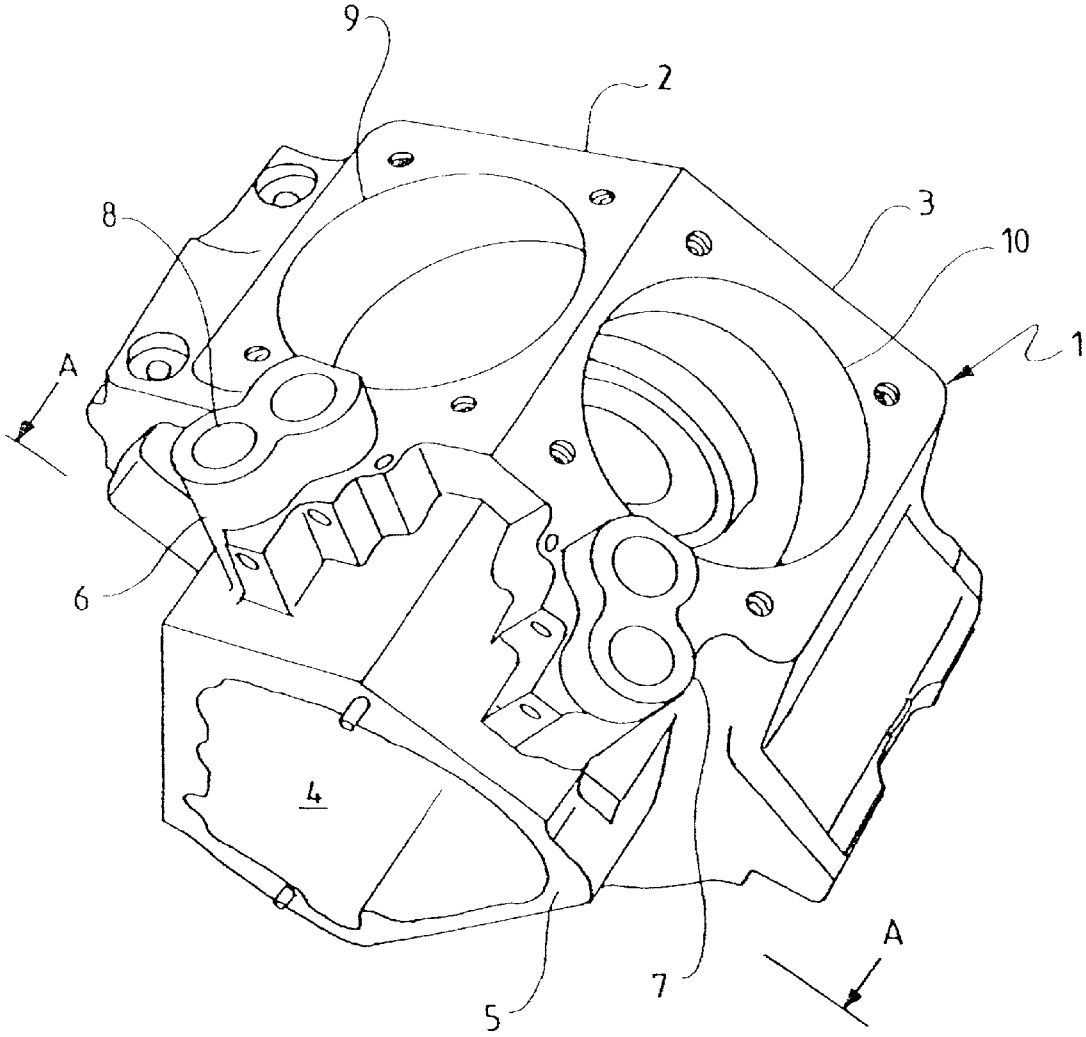
FIG. 1 is a perspective view of a crankcase for use with the camshaft drive mechanism of the invention.

Referring first to FIG. 1, there is shown crankcase 1 having faces 2 and 3 for mounting cylinders thereon with the axes of the cylinders at 45°. The crankcase further has a cam chest 4 at one end thereof which in an assembled engine has a cover thereon which abuts face 5 of the cam chest. Crankcase 1 also includes tappet blocks 6 and 7 which house the cam followers.

In an assembled engine, pushrods extend from cam followers through apertures in the tappet blocks to the rocker arms. One such aperture is indicated at 8. The connecting rods extend through apertures 9 and 10 in crankcase 1 to interconnect the pistons and the crankshaft.

Crankcase 1 is an aluminum casting which is machined as necessary to provide surfaces for abutment of other engine components and tapped holes for securing components to the crankcase. Tappet blocks 6 and 7 are similarly machined to provide cylinders for the cam followers (not shown in the drawing).

Figure 2:
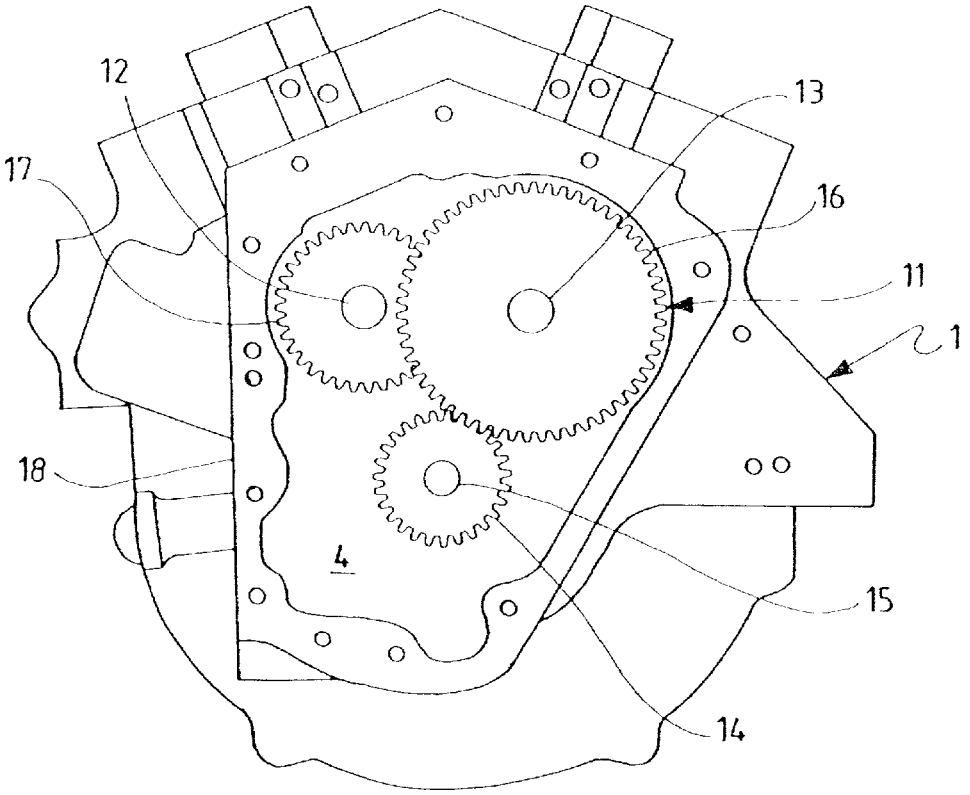
FIG. 2 is an end view of the crankcase of FIG. 1 with the drive mechanism in situ.

Turning now to FIG. 2, there is shown crankcase 1 with camshaft drive mechanism 11 in situ. Camshaft drive mechanism 11 comprises camshafts 12 and 13, a drive gear 14 at an end of crankshaft 15, a primary (idler) gear 16, and secondary gears on the camshafts, one of which secondary gears can be seen as item 17. Mechanism 11 is housed in cam chest 4 which is also defined by side wall 18. Camshafts 12 and 13 are located in bearings 34 and 35, respectively, in a back wall 33 (see FIG. 4) of cam chest 4, and in bearings 26 and 27, respectively, in the cover 28 (see FIG. 4) over the cam chest in an assembled engine. Crankshaft 15 is carried by the conventional bearings used in other engines of the type.

Figure 3:
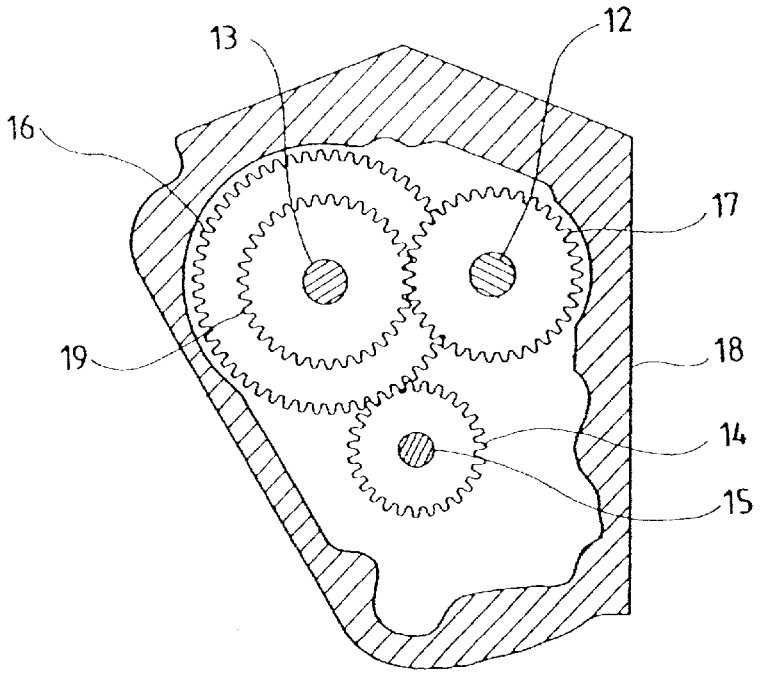
FIG. 3 is a cross-sectional view at A—A of FIG. 1.

FIG. 3 is a reverse view of mechanism 11 as shown in FIG. 2. In the former figure, cam chest wall 18 can be seen as well as (in cross-section) camshafts 12 and 13 and crankshaft 15. Also visible are drive gear 14, primary gear 16, and secondary gears 17 and 19.

Figure 4:
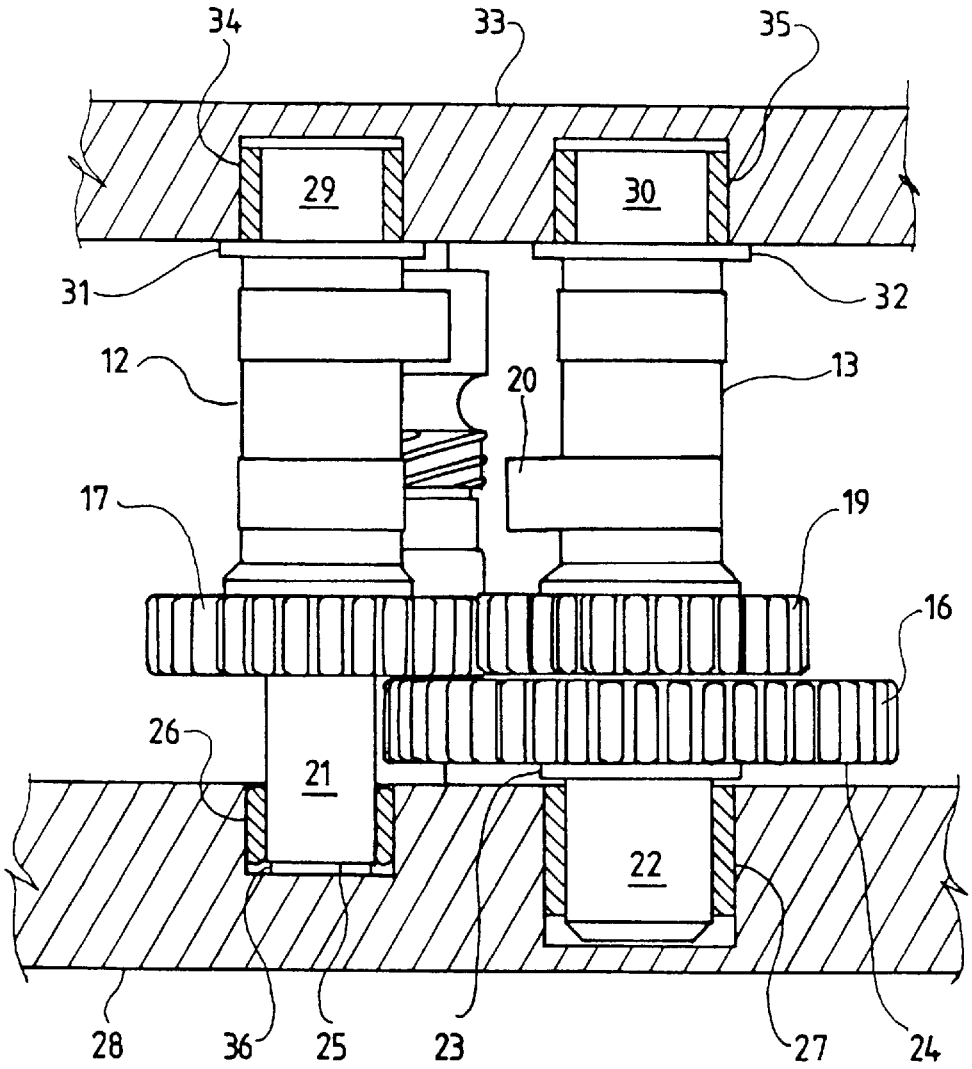
FIG. 4 is a plan view of portions of camshafts with gears of the drive mechanism according to the invention thereon.

The disposition of the primary and secondary gears can be appreciated from FIG. 4 which shows camshafts 12 and 13 with primary gear 16 and secondary gear 19 on camshaft 13, and secondary gear 17 on camshaft 12. A lobe 20 of a cam on camshaft 13 is visible in the figure. Ends 21 and 22 of camshafts 12 and 13 are received in bearings 26 and 27, respectively, in cam chest cover 28 as noted above.

To prevent longitudinal movement of camshafts 12 and 13 and thus to maintain correct alignment of gears 14, 16, 17 and 19, thrust interfaces are provided. The ends 29 and 30, respectively, of camshafts 12 and 13 distal the secondary gears are stepped. Thrust washers 31 and 32 are positioned against the steps which washers abut back wall 33 of cam chest 4 about bearings 34 and 35 when the camshafts are in situ. (Back wall 33 also comprises portion of the wall of the crankcase.)

Longitudinal movement of camshaft 13 in the opposite direction is prevented by a thrust washer 23 about end 22 of the camshaft. This washer fills the space between face 24 of primary gear 16 and the inner surface of cam chest cover 28 which has the bearing 27 for end 22 of the camshaft.

To provide clearance for primary gear 16, end 21 of camshaft 12—which end, as indicated above, is received in a bearing in the cam chest cover—is machined at that diameter through to secondary gear 17. Consequently, a step can not be provided for abutment of a thrust washer. In this instance, thrust is controlled by providing a thrust washer 36 at the distal end of the housing in cam chest cover 28 for bearing 26 which receives end 21 of camshaft 12. Thrust washer 36 abuts end 25 of camshaft 12.

It will be appreciated by those of skill in the art that end float of camshaft 12 could also be controlled by including a caged ball at the end of camshaft 12 or by providing a yoke the arms of which are located in a groove in end 21 of the camshaft.

In the exemplified crankcase, the axes of camshafts 12 and 13 are 2.1875 inches apart while the axis of crankshaft 15 is 2.5312 inches from the axis of camshaft 13. All gears have a pitch of 16 dp with the following number of teeth per gear: drive gear 14, 27 teeth; primary gear 16, 54 teeth; and secondary gears 17 and 19, 35 teeth each.

Gears are manufactured from any material suitable for high-stress camshaft applications and are either pressed on to shafts as friction fits or machined from a casting of an integral shaft and gear(s).

To test the efficacy of the camshaft drive mechanism illustrated above, a vee-twin engine of 113 $in^3$ was prepared from after-sale components save that the twin camshafts were driven by the illustrated mechanism. The performance of this engine was compared with a stock Harley Davidson 88 $in^3$ engine.

The horsepower and torque of the engine including the camshaft drive mechanism as illustrated were found to be essentially unchanged after about 12 months use. By comparison, the horsepower and torque of the Harley Davidson engine were found to have decreased by 5 to 7% over the same period. These decreases were considered to be due to deterioration of the chain driving the camshafts.

It will be appreciated by those of ordinary skill in the art that with the benefit of this disclosure, many variations can be made to the invention exemplified above without departing from the broad ambit and scope of the invention. Accordingly, it is the claims set forth below that are intended to define the exclusive rights of the invention.

I claim:

1. A crankcase for an internal combustion engine of the type comprising twin cylinders arranged in a vee in a plane normal to the axis of the crankshaft of said engine, wherein said crankcase includes a camshaft drive mechanism comprising a first camshaft for actuating inlet and exhaust valves of one of said cylinders and a second camshaft for actuating inlet and exhaust valves of the other of said cylinders, which camshafts rotate on axes parallel to the axis of said crankshaft with said camshafts being driven by a gear on said crankshaft which engages a primary gear on said first camshaft with an adjacent secondary gear on said first camshaft imparting counter-rotation on said second camshaft via an identical secondary gear on said second camshaft; and wherein said crankcase casting includes tappet blocks as integral components of said casting.

2. The crankcase according to claim 1, wherein said gears of said camshaft drive mechanism have a pitch of 16 dp, and said drive gear has 27 teeth, said primary gear has 54 teeth, and said secondary gears have 35 teeth.

3. An internal combustion engine of the type comprising twin cylinders arranged in a vee in a plane normal to the crankshaft of said engine and having a crankcase including a camshaft drive mechanism comprising a first camshaft for actuating inlet and exhaust valves of one of said cylinders and a second camshaft for actuating inlet and exhaust valves of the other of said cylinders, which camshafts rotate on axes parallel to the axis of said crankshaft and with said camshafts being driven by a gear on said crankshaft which engages a primary gear on said first camshaft with an adjacent secondary gear on said first camshaft imparting counter-rotation on said second camshaft via an identical secondary gear on said second camshaft; and wherein said crankcase casting includes tappet blocks as integral components of said casting.

4. The internal combustion engine according to claim 3, wherein said gears of said camshaft drive mechanism have a pitch of 16 dp, and said drive gear has 27 teeth, said primary gear has 54 teeth, and said secondary gears have 35 teeth.

5. An internal combustion engine of the type comprising twin cylinders arranged in a vee in a plane normal to the crankshaft of said engine and including a camshaft drive mechanism comprising a first camshaft for actuating inlet and exhaust valves of one of said cylinders and a second camshaft for actuating inlet and exhaust valves of the other of said cylinders, which camshafts rotate on axes parallel to the axis of said crankshaft with said camshafts being driven by a gear on said crankshaft which engages a primary gear on said first camshaft with an adjacent secondary gear on said first camshaft imparting counter-rotation on said second camshaft via an identical secondary gear on said second camshaft; wherein said camshaft drive mechanism is housed in a cam chest having a back wall with bearings therein for ends of said first and second camshafts, and said cam chest has a cover which includes bearings for the other ends of said first and second camshafts; longitudinal movement of said first camshaft is prevented by thrust washers between steps on said camshaft and said bearings; and longitudinal movement of said second camshaft is prevented by a thrust washer between a step on said camshaft and said back wall bearing therefor and a thrust interface within the housing for the bearing for said camshaft in said cam chest cover.

6. The internal combustion engine according to claim 5, wherein said thrust interface comprises a thrust washer in said housing which abuts the end of said second camshaft.

7. The internal combustion engine according to claim 5, wherein said gears of said camshaft drive mechanism have a pitch of 16 dp, and said drive gear has 27 teeth, said primary gear has 54 teeth, and said secondary gears have 35 teeth.

8. A crankcase for an internal combustion engine of the type comprising twin cylinders arranged in a vee in a plane normal to the axis of the crankshaft of said engine, wherein said crankcase includes a camshaft drive mechanism comprising a first camshaft for actuating inlet and exhaust valves of one of said cylinders and a second camshaft for actuating inlet and exhaust valves of the other of said cylinders, which camshafts rotate on axes parallel to the axis of said crankshaft with said camshafts being driven by a gear on said crankshaft which engages a primary gear on said first camshaft with an adjacent secondary gear on said first camshaft imparting counter-rotation on said second camshaft via an identical secondary gear on said second camshaft; wherein said camshaft drive mechanism is housed in a cam chest having a back wall with bearings therein for ends of said first and second camshafts, and said cam chest has a cover which includes bearings for the other ends of said first and second camshafts; longitudinal movement of said first camshaft is prevented by thrust washers between steps on said camshaft and said bearings; and longitudinal movement of said second camshaft is prevented by a thrust washer between a step on said camshaft and said back wall bearing therefor and a thrust interface within the housing for the bearing for said camshaft in said cam chest cover.

9. The crankcase according to claim 8, wherein said thrust interface comprises a thrust washer in said housing which abuts the end of said second camshaft.

10. The crankcase according to claim 8, wherein said gears of said camshaft drive mechanism have a pitch of 16 dp, and said drive gear has 27 teeth, said primary gear has 54 teeth, and said secondary gears have 35 teeth.

* * * * *